US010332705B2

(12) United States Patent
Heinz

(10) Patent No.: US 10,332,705 B2
(45) Date of Patent: Jun. 25, 2019

(54) ZERO-CURRENT PULSE WITH CONSTANT CURRENT GRADIENT FOR INTERRUPTING A DIRECT CURRENT

(71) Applicant: SIEMENS AKTIENGESELLSCHAFT, Munich (DE)

(72) Inventor: Thomas Heinz, Frankfurt am Main (DE)

(73) Assignee: Siemens Aktiengesellschaft, Munich (DE)

( * ) Notice: Subject to any disclaimer, the term of this patent is extended or adjusted under 35 U.S.C. 154(b) by 174 days.

(21) Appl. No.: 15/500,172

(22) PCT Filed: Jul. 9, 2015

(86) PCT No.: PCT/EP2015/065714

§ 371 (c)(1),
(2) Date: Jan. 30, 2017

(87) PCT Pub. No.: WO2016/015975

PCT Pub. Date: Feb. 4, 2016

(65) Prior Publication Data

US 2017/0263399 A1 Sep. 14, 2017

(30) Foreign Application Priority Data

Jul. 30, 2014 (DE) ..... 10 2014 214 956

(51) Int. Cl.

| | |
|---|---|
| ***H01H 33/16*** | (2006.01) |
| ***H01H 33/59*** | (2006.01) |
| ***H01H 33/66*** | (2006.01) |

(52) U.S. Cl.
CPC ..... *H01H 33/596* (2013.01); *H01H 33/167* (2013.01); *H01H 33/66* (2013.01)

(58) Field of Classification Search
None
See application file for complete search history.

(56) References Cited

U.S. PATENT DOCUMENTS 5,402,297 A 3/1995 Ouchi et al.
9,178,348 B2 11/2015 Gaxiola et al.
(Continued)

FOREIGN PATENT DOCUMENTS

CN 2852361 Y 12/2006
DE 69302716 T2 1/1997
(Continued)

*Primary Examiner* — Thienvu V Tran
*Assistant Examiner* — David M Stables
(74) *Attorney, Agent, or Firm* — Laurence Greenberg; Werner Stemer; Ralph Locher

(57) ABSTRACT

A configuration for generating a zero current pulse for generating a zero current crossing in an electrical component through which a direct current flows, in particular a vacuum interrupter, includes a switch and an electrical energy storage device or store having two poles through which the electrical energy storage device can be charged by a voltage source. A loop can be formed by the energy storage device, the electrical component through which the direct current flows and the switch, so that the energy storage device can be discharged by closing the switch while generating a zero current pulse counter to the direct current across the electrical component. The energy storage device has a plurality of energy storage elements for mutual generation of a zero current pulse.

7 Claims, 1 Drawing Sheet

(56) References Cited

U.S. PATENT DOCUMENTS

| | | | | |
|---|---|---|---|---|
| 2014/0299579 | A1* | 10/2014 | Hartmann | H01H 33/596 218/145 |
| 2015/0108090 | A1 | 4/2015 | Oates et al. | |

FOREIGN PATENT DOCUMENTS

| | | | | |
|---|---|---|---|---|
| DE | 102007004527 | A1 | 7/2008 | |
| DE | 102011079723 | A1 | 1/2013 | |
| DE | 102011082568 | A1 | 3/2013 | |
| DE | 102011083514 | A1 * | 3/2013 | H01H 33/596 |
| JP | S57176623 | A | 10/1982 | |
| JP | H0950741 | A | 2/1997 | |
| JP | 2000175451 | A | 6/2000 | |
| JP | 2005222705 | A | 8/2005 | |
| JP | 5265063 | B1 | 8/2013 | |
| WO | 2013178696 | A1 | 12/2013 | |

* cited by examiner

ZERO-CURRENT PULSE WITH CONSTANT CURRENT GRADIENT FOR INTERRUPTING A DIRECT CURRENT

BACKGROUND OF THE INVENTION

Field of the Invention

The present invention relates to an arrangement for generating a zero-current pulse for generating a zero-current crossing in an electrical component through which a direct current flows, in particular a vacuum interrupter.

Description of the Related Art

A vacuum interrupter is frequently employed as a load or power switch for currents in alternating current networks. To switch off the anode current or the switched current, the vacuum interrupter here requires a negative voltage which is provided by the negative half wave of the alternating voltage. In the case in which a direct current is to be interrupted, a current pulse, or a zero-current pulse, which can be superimposed onto the direct current in order to generate the necessary zero-current crossing, is required, as a result of the absence of a zero crossing.

In the method known until now for generating an artificial zero-current crossing by means of a zero-current pulse, a simple resonant RLC circuit (a resonant circuit based on resistor, inductor, capacitor) is usually employed. If the direct current is to be switched off, the vacuum interrupter is opened, the zero-current pulse is impressed, and the current interrupted. A zero-current pulse generated by a resonant RLC circuit here has a sinusoidal current curve. The value of the frequency of the resonant RLC circuit normally here lies in the range of kilohertz, and is thus significantly above the frequencies that typically occur in alternating current networks.

The interruption of current by the vacuum interrupter occurs relatively reliably up to a certain maximum current gradient dI/dt (time derivative of the current) at the zero-current crossing. The current gradient of the resonant RLC circuit here corresponds to a cosine function. The dimensioning of the resonant RLC circuit can only be optimized for the level of a particular, specifiable current. With different switched currents, and a zero-current pulse that remains the same, different current gradients, which are not necessarily optimum, therefore emerge at the zero crossing of the switched current at the time when the current is interrupted.

A resonant RLC circuit that is designed to generate a Zero-current pulse with a high amplitude thus exhibits an initially very high current gradient which however falls according to the cosine function with increasing time and amplitude. If the direct current that must be compensated for is large, the zero-current crossing thus occurs at a time at which the current gradient has already fallen in accordance with the cosine function, and is thus sufficiently low. If, however, the direct current that is to be compensated for is low, a zero-current crossing already occurs at an early point in time at which the current gradient of the zero-current pulse is still very high, possibly being too high.

BRIEF SUMMARY OF THE INVENTION

The object of the invention is to specify an arrangement for generating a zero-current pulse that permits the interruption of switched currents of different levels with the most constant possible current gradient dI/dt.

The object is achieved through the features of the independent claims. Advantageous embodiments are given in the dependent claims.

According to the invention, an arrangement is provided for generating a zero-current pulse for generating a zero-current crossing in an electrical component through which a direct current flows, in particular a vacuum interrupter, wherein the arrangement comprises an electrical energy store with two poles via which the electrical energy store can be charged by a voltage source, and a switch. A loop can be formed here with the arrangement by the energy store, the electrical component through which the direct current flows, and the switch, so that the energy store can be discharged by closing the switch, while generating a zero-current pulse counter to the direct current across the electrical component, wherein the energy store comprises a plurality of energy storage elements for mutual generation of a zero-current pulse.

An advantage of an arrangement of this sort is that the form, i.e. the course of the amplitude against time, of the zero-current pulse can be shaped by a superposition of the discharge curves of a plurality of energy storage elements. In this way, zero-current pulses of almost any form that might be necessary for the interruption of direct currents in an electrical component can be generated. The concept of the electrical component is here to be understood in a general sense, such that it also refers to a more complex—possibly integrated—circuit, or to a device, in particular a conventional alternating current device.

Advantageously, the energy storage elements differ in design, so that the energy storage elements exhibit different discharge curves. The discharge of the plurality of energy storage elements for the mutual formation of the zero-current pulse can be implemented in a variety of ways, for example parallel, offset in time, dependent on one another or chained.

Advantageously, the energy store is so designed that when the switch is closed a resonant circuit can be formed by the loop, so that the zero-current pulse exhibits alternating directions. A design of this sort offers the advantage that the node at which the energy store can be connected to the line through which the direct current flows can be positioned upstream of the electrical component in the direction of the direct current. In this case, when the energy store is discharged, the direct current flowing through the electrical component is first reinforced by the zero-current pulse, before this changes its direction as a result of the resonant circuit that has been formed, and, after half an oscillation, compensates the direct current with its negative direction.

Advantageously, the plurality of energy storage elements form a chain conductor for the mutual generation of a zero-current pulse, wherein the energy storage elements are formed as chain links, each with a capacitor.

The term "chain conductor" refers here to a chain-like electrical connection of chain links, all of the same design, in the form of electrical circuit arrangements.

The use of chain links of the same type offers the advantage of a manufacturability that can be rationalized, while chaining offers the advantage of being able to form temporal dependencies or sequences.

The chain links of the chain conductor advantageously comprise inductors, resistors and capacitors. A design using passive components can be built economically, wherein an arrangement, particularly consisting of inductors, resistors and capacitors, can be constructed that exhibits a simple construction and which moreover permits a controllable discharge process of a capacitor as an energy storage element.

Advantageously, each single chain link is designed as an RLC link, meaning that each chain link is formed as a series circuit of an inductor, a resistor and a capacitor, wherein the series circuit of a first chain link is formed between the poles of the energy store and the series circuit of a following chain link is connected in parallel with the capacitor of the respectively previous chain link. A design of this sort offers the possibility of constructing resonant circuits of different frequencies, resulting in zero-current pulse components with different current gradients. In particular it offers the possibility of constructing zero-current pulses whose negative half wave has a low current gradient at high amplitude. A vacuum interrupter for interrupting a high direct current thus requires a zero-current pulse with a high amplitude and a low current gradient. In comparison with an energy store that satisfies the appropriate conditions and is constructed of just one, simple resonant RLC circuit, a corresponding, and suitably parameterized chain conductor of RLC links requires less energy to be stored while outputting comparatively short current pulses, with small physical dimensions.

Advantageously, the arrangement comprises a plurality of energy storage elements that are dimensioned such that the zero-current pulse arising as a result of the mutual discharging of the energy storage elements exhibits a current gradient which, in sections, is on the whole nearly constant. The arrangement can, for example, be implemented in such a way that it comprises a chain conductor with a plurality of chain links whose inductors, resistors and capacitors are dimensioned such that the zero-current pulse exhibits a current gradient which, in sections, is on the whole nearly constant.

Such an arrangement offers the advantage that it can, for example, be designed for a specific, nearly constant current gradient which exhibits, independently of the value of a direct current to be compensated, the intended current gradient at the time of the zero-current crossing of the zero-current pulse. With appropriate parameterization, such an arrangement is thus for example suitable for compensating a direct current flowing through a vacuum interrupter that is constant at the time of switching, independently of its magnitude, with a specifiable current gradient.

In other words, zero-current crossings can be generated for direct currents of different magnitudes with optimum current gradient by the arrangement with a design of this sort.

Advantageously the energy store comprises a plurality, particularly preferably three, energy storage elements that are dimensioned such that the zero-current pulse arising as a result of the mutual discharging of the energy storage elements exhibits on the whole an approximately triangular or ramp-shaped current curve. Particularly preferably, the energy store comprises a chain conductor with three chain links, whose inductors, resistors and capacitors are dimensioned such that the zero-current pulse exhibits on the whole an approximately triangular or ramp-shaped current curve. Such curves of the zero-current pulse against time can easily be implemented with passive components, and offer in sections a zero-current pulse with constant current gradient.

Advantageously, the arrangement is further designed such that the poles of the energy store can be connected through a charging resistor to the voltage source. The arrangement is furthermore advantageously constructed here such that this voltage source is the same voltage source that supplies the electrical energy for the direct current that is to be compensated. Such a design allows a second voltage source to be omitted. The charging resistor is here advantageously arranged such that it forms a second loop with the voltage source, the electrical component and the switch, and is thus not contained in the previously mentioned loop of the switch, the electrical component and the energy store, nor is it arranged in the current path of the direct current that is to be compensated.

Furthermore advantageously, the arrangement is designed such that the arrangement comprises an energy absorber that is arranged in parallel with the electrical component. With this, the energy released as a result of the interruption when the direct current through the electrical component is interrupted can be absorbed. Advantageously the energy absorber is designed as a metal oxide arrester, for example a metal oxide resistor or a metal oxide varistor. Metal oxide arresters can be made substantially resistant to aging, and are suitable for being able to absorb the energy arising during an arrest process.

Advantageously, the arrangement is used for generating a zero-current pulse in an electrical component through which a direct current flows, wherein the electrical component is a vacuum interrupter. A direct current switch can be built by the arrangement when used in this way.

BRIEF DESCRIPTION OF THE SEVERAL VIEWS OF THE DRAWING

The invention is explained in more detail below with reference to the attached drawings in terms of preferred exemplary embodiments.

Here

DESCRIPTION OF THE INVENTION

Figure 1:
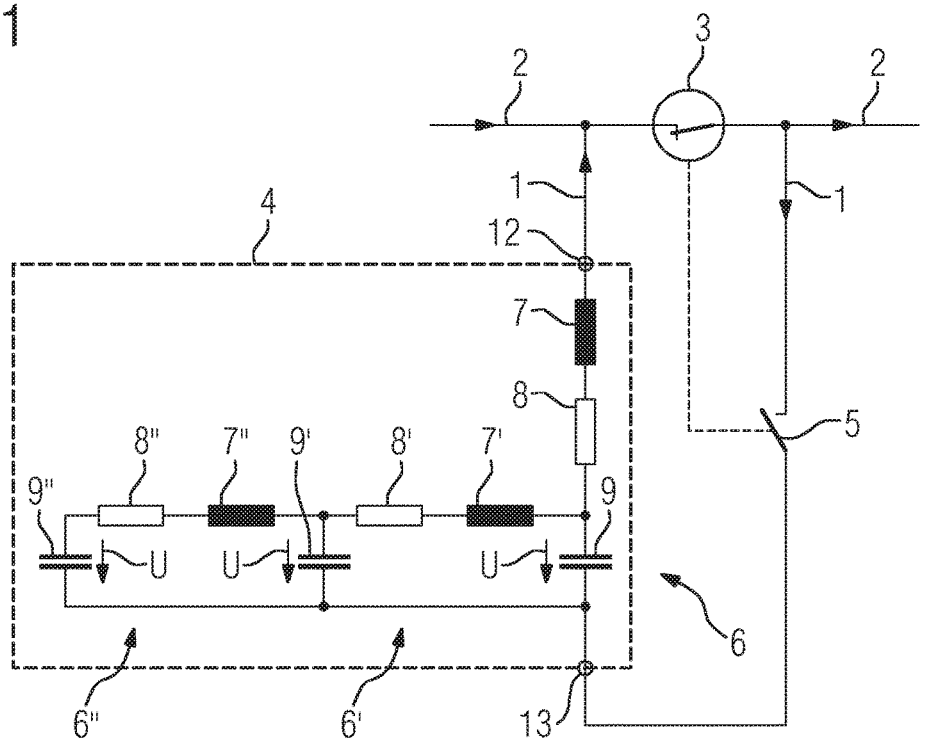
FIG. 1 shows an exemplary embodiment of the invention with a chain conductor of three chain links.

FIG. 1 shows a preferred exemplary embodiment of the invention. In FIG. 1 an arrangement for generating a zero-current pulse 1 for generating of a zero-current crossing in an electrical component 3 through which a direct current 2 flows can be seen, wherein the electrical component 3 is implemented as a vacuum interrupter.

Figure 2:
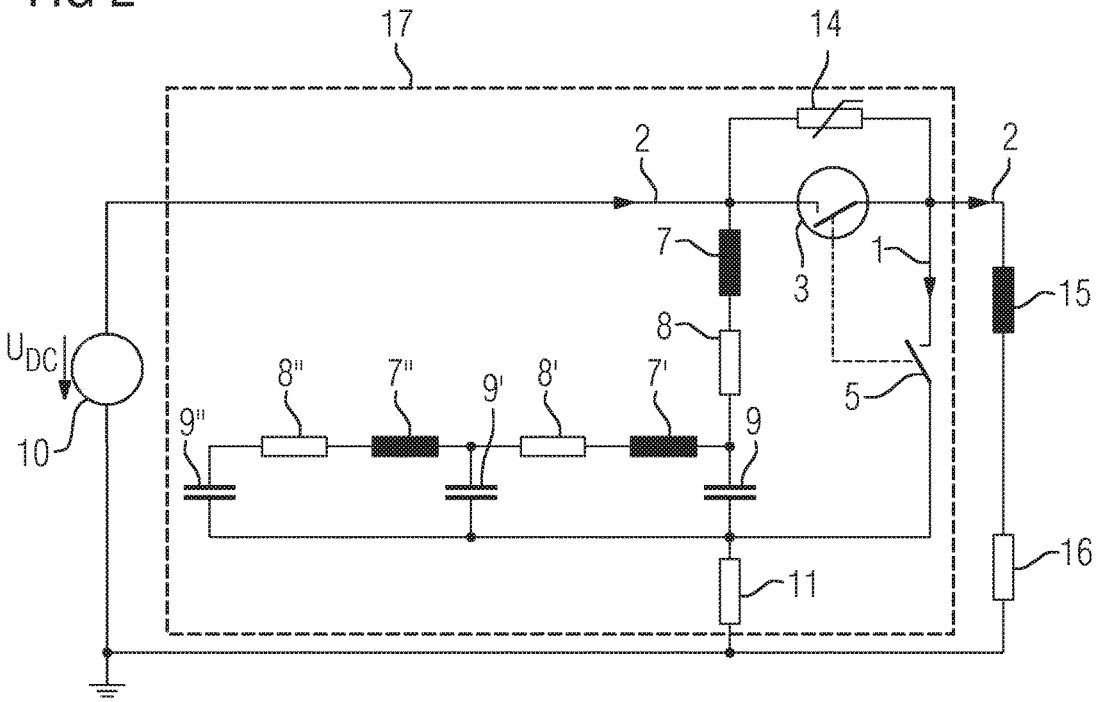
FIG. 2 shows an exemplary embodiment of a use of the invention for the construction of a direct current switch.

The arrangement comprises an electrical energy store 4 with two poles 12, 13, which can be charged from a voltage source 10 illustrated in FIG. 2. The arrangement further, through the energy store 4, the electrical component 3 through which direct current flows, and a switch 5, comprises a loop, so that the energy store 4 can be discharged by closing the switch 5 while generating a zero-current pulse 1 through which the direct current 2 flowing through the electrical component 3 is at first reinforced.

The energy store 4 here comprises a plurality of energy storage elements in the form of chain links 6, 6' and 6" of a chain conductor for the mutual generation of a zero-current pulse 1. The chain links 6, 6', 6" of the chain conductor comprise inductors 7, 7', 7", resistors 8, 8', 8" and capacitors 9, 9', 9". Each chain link 6, 6', 6" is here formed of a series circuit of an inductor 7, 7', 7", a resistor 8, 8', 8" and a capacitor 9, 9', 9". A series circuit of a first chain link 6 is formed between the poles 12, 13 of the energy store 4. The series circuit of a following chain link 6', 6" is connected in parallel with the capacitor 9, 9' of the respectively previous chain link 6, 6'.

With a design of this sort, a resonant circuit is formed by the chain conductor whose oscillations—when the electrical component 3 is in a conducting state—is initiated by closing the switch 5.

When the switch 5 is closed, the capacitors 9, 9', 9" are discharged, forming a positive half wave of a zero-current pulse 1. The positive half wave of the zero-current pulse 1 exhibits the same direction as the direct current 2, so that the two currents are initially added in the electrical component 3.

After discharging the capacitors 9, 9', 9", the inductors 7, 7', 7" maintain the zero-current pulse 1, until a reversal of the polarity of the voltage U in the capacitors 9, 9', 9" occurs. As the voltage continues to develop, the amplitude of the zero-current pulse 1 falls down to its zero crossing.

As a result of the reversal of the polarity of the voltage U in the capacitors 9, 9', 9", the positive half wave of the zero-current pulse 1 is followed by a negative half wave. This negative half wave of the zero-current pulse 1 acts in the opposite direction to the direct current 2, so that, with appropriate dimensioning, the direct current 2 can be compensated by the negative half wave of the zero-current pulse 1, and a zero-current crossing can be achieved for the sum of the two currents in the electrical component 3.

The inductors 7, 7', 7", resistors 8, 8', 8" and capacitors 9, 9', 9" of the chain links 6, 6', 6" are dimensioned such that the zero-current pulse 1 exhibits a current gradient which, in sections, is on the whole approximately constant.

FIG. 2 shows an exemplary embodiment of a use of the invention for the construction of a direct current switch 17. The embodiment of the energy store 4, and its interaction with the electrical component 3 and with the switch 5 are identical to the exemplary embodiment in FIG. 1. In addition to the arrangement described in FIG. 1, it can be seen in FIG. 2 that the energy store 4 shown in FIG. 1, here represented by the chain conductor with the inductors 7, 7', 7", the resistors 8, 8', 8" and the capacitors 9, 9', 9", is connected to the voltage source 10 through a charging resistor 11.

The electrical energy for the direct current 2 that is to be compensated is, furthermore, supplied from the same voltage source 10. The charging resistor 11 is here arranged such that it forms a second loop with the voltage source 10, the electrical component 3 and the switch 5, and is thus not contained in the previously mentioned loop of the switch 5, the electrical component 3 and the energy store 4, nor is it arranged in the current path of the direct current 2 that is to be compensated. A further, third loop, consisting of the voltage source 10, the energy store 4 and the charging resistor 11 allows the capacitors 9, 9', 9" to be charged up to the voltage $U_{DC}$ of the voltage source 10 as long as the switch 5 is open.

If the switch 5 is closed, the capacitors 9, 9', 9" of the energy store 4 discharge through the electrical component 3 and the switch 5 in the form of the zero-current pulse 1. The electrical component 3, implemented in the form of a vacuum interrupter, is coupled with the switch 5, and is opened as the switch 5 is closed, so that when the zero-current crossing caused by the negative half wave of the zero-current pulse 1 is reached, the direct current 2 can be switched off.

A switched load with an inductive component 15 and an ohmic component 16 is connected through the direct current switch 17 to the voltage source 10 with the voltage $U_{DC}$, by which the direct current 2 is determined. It can also be seen in FIG. 2 that the arrangement comprises an energy absorber 14 that is arranged in parallel with the electrical component 3.

When the direct current 2 is interrupted by the electrical component 3, an excess voltage resulting from the inductive component 15 of the switched load arises across the electrical component 3, and can be absorbed by the energy absorber 14 which is implemented as a metal oxide arrester.

REFERENCE SIGNS

1 Zero-current pulse
2 Direct current
3 Electrical component
4 Energy store
5 Switch
6 Chain link
7 Inductor
8 Resistor
9 Capacitor
10 Voltage source
11 Charging resistor
12 Pole of the energy store
13 Pole of the energy store
14 Energy absorber
15 Switched load, inductive component
16 Switched load, ohmic component
17 Direct current switch

The invention claimed is:

1. A configuration for generating a zero-current pulse for generating a zero-current crossing in an electrical component or a vacuum interrupter through which a direct current flows, the configuration comprising:

an electrical energy storage device having two poles, through which said electrical energy storage device can be charged by a voltage source, said electrical energy storage device including a plurality of energy storage elements for mutual generation of a zero-current pulse;

said plurality of energy storage elements forming a chain conductor for the mutual generation of the zero-current pulse;

said plurality of energy storage elements being chain links each being formed as a respective series circuit of an inductor, a resistor and a capacitor;

said chain links including at least a first chain link and a second chain link, following said first chain link;

said series circuit of said first chain link being formed between said poles of said electrical energy storage device and said series circuit of said second chain link, is connected in parallel with said capacitor of said first chain link; and a switch;

said electrical energy storage device, the electrical component and said switch forming a loop for discharging said electrical energy storage device by closing said switch while generating the zero-current pulse flowing counter to the direct current across the electrical component.

2. The configuration according to claim 1, wherein said electrical energy storage device is configured to cause said loop to form a resonant circuit when said switch is closed causing the zero-current pulse to have alternating directions.

3. The configuration according to claim 1, wherein said energy storage elements are dimensioned to provide the zero-current pulse arising as a result of the mutual discharging of said energy storage elements with a current gradient which, in sections, is as a whole nearly constant.

4. The configuration according to claim 1, which further comprises a charging resistor connected between the voltage source and said poles, of said electrical energy storage device.

5. The configuration according to claim 1, which further comprises an energy absorber connected in parallel with the electrical component.

6. The configuration according to claim 5, wherein said energy absorber is a metal oxide arrester.

7. A method for generating a zero-current pulse in an electrical component through which a direct current flows, the method comprising the following steps:

providing a vacuum interrupter as the electrical component through which a direct current flows;

providing an electrical energy storage device having two poles, through which the electrical energy storage device can be charged by a voltage source, the electrical energy storage device including a plurality of energy storage elements for mutual generation of a zero-current pulse;

forming a chain conductor with the plurality of energy storage elements for the mutual generation of the zero-current pulse;

providing the plurality of energy storage elements as chain links each being formed as a respective series circuit of an inductor, a resistor and a capacitor, the chain links including at least a first chain link and a second chain link, following the first chain link;

forming the series circuit of the first chain link between the poles of the electrical energy storage device and connecting the series circuit of the second chain link in parallel with the capacitor of the first chain link;

providing a switch;

forming a loop including the electrical energy storage device, the vacuum interrupter and the switch; and discharging the electrical energy storage device by closing the switch while generating the zero-current pulse flowing counter to the direct current across the vacuum interrupter.

* * * * *